5/31/83 OR 4,386,343

United States Patent [19]

Shiveley

[11] 4,386,343

[45] May 31, 1983

[54] ACOUSTIC EMISSION INTRUDER ALARM SYSTEM

[76] Inventor: James T. Shiveley, 10965 Tanager Trail, Brecksville, Ohio 44141

[21] Appl. No.: 184,118

[22] Filed: Sep. 4, 1980

Related U.S. Application Data

[63] Continuation of Ser. No. 962,702, Nov. 20, 1978, abandoned.

[51] Int. Cl.[3] ..... G08B 13/00

[52] U.S. Cl. ..... 340/566; 340/515; 340/529; 340/550

[58] Field of Search ..... 340/566, 515, 529, 550, 340/691, 692; 310/311

[56] References Cited

U.S. PATENT DOCUMENTS

| | | | |
|---|---|---|---|
| 2,345,771 | 4/1944 | Reynolds | 340/566 |
| 3,192,516 | 6/1965 | Simpkins et al. | 340/692 |
| 3,543,261 | 11/1970 | Burney | 340/566 |
| 3,579,220 | 5/1971 | Stevenson, Jr. | 340/566 |
| 3,745,552 | 7/1973 | Wilt | 340/566 |
| 3,828,338 | 8/1974 | Kato | 340/529 |
| 4,054,867 | 10/1977 | Owens | 340/566 |
| 4,081,785 | 3/1978 | Ravis et al. | 340/566 |
| 4,099,168 | 7/1978 | Kedjierski et al. | 340/566 |
| 4,180,811 | 12/1979 | Yoshimura et al. | 340/566 |

*Primary Examiner*—Glen R. Swann, III
*Attorney, Agent, or Firm*—Yount & Tarolli

[57] ABSTRACT

An acoustic emission burglary detection system for detecting physical attacks made on a protected structure such as a vault, safe or the like. Sensors (13, 14) mounted on the protected structure detect acoustic emission stress wave signals produced by an attack and provide an event signal of a corresponding frequency and with an amplitude and duration dependent upon those of the stress wave signals. Event signals exhibiting a frequency less than 50,000 Hz are much less likely to have been originated by a physical attack upon the protected structure and are filtered out. The remaining event signals which exceed a predetermined level are integrated over a predetermined time period. If the resulting value exceeds a predetermined level an alarm is activated. Means are provided for testing the detection circuit by providing electrical pulses through one of the sensors to cause it to generate mechanical stress wave signals in the protected structure which can be detected and processed by the detection circuitry.

9 Claims, 1 Drawing Figure

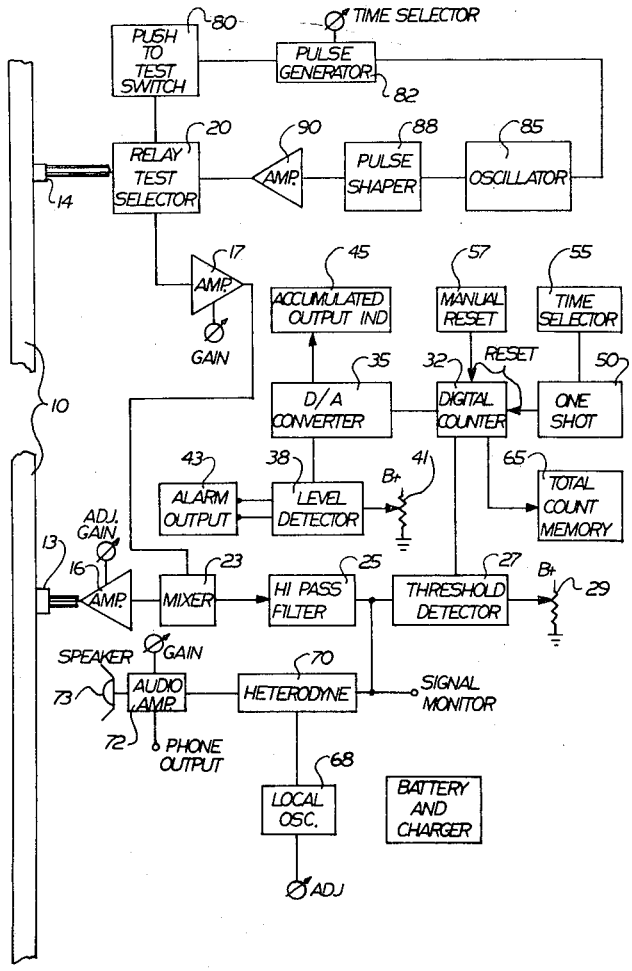

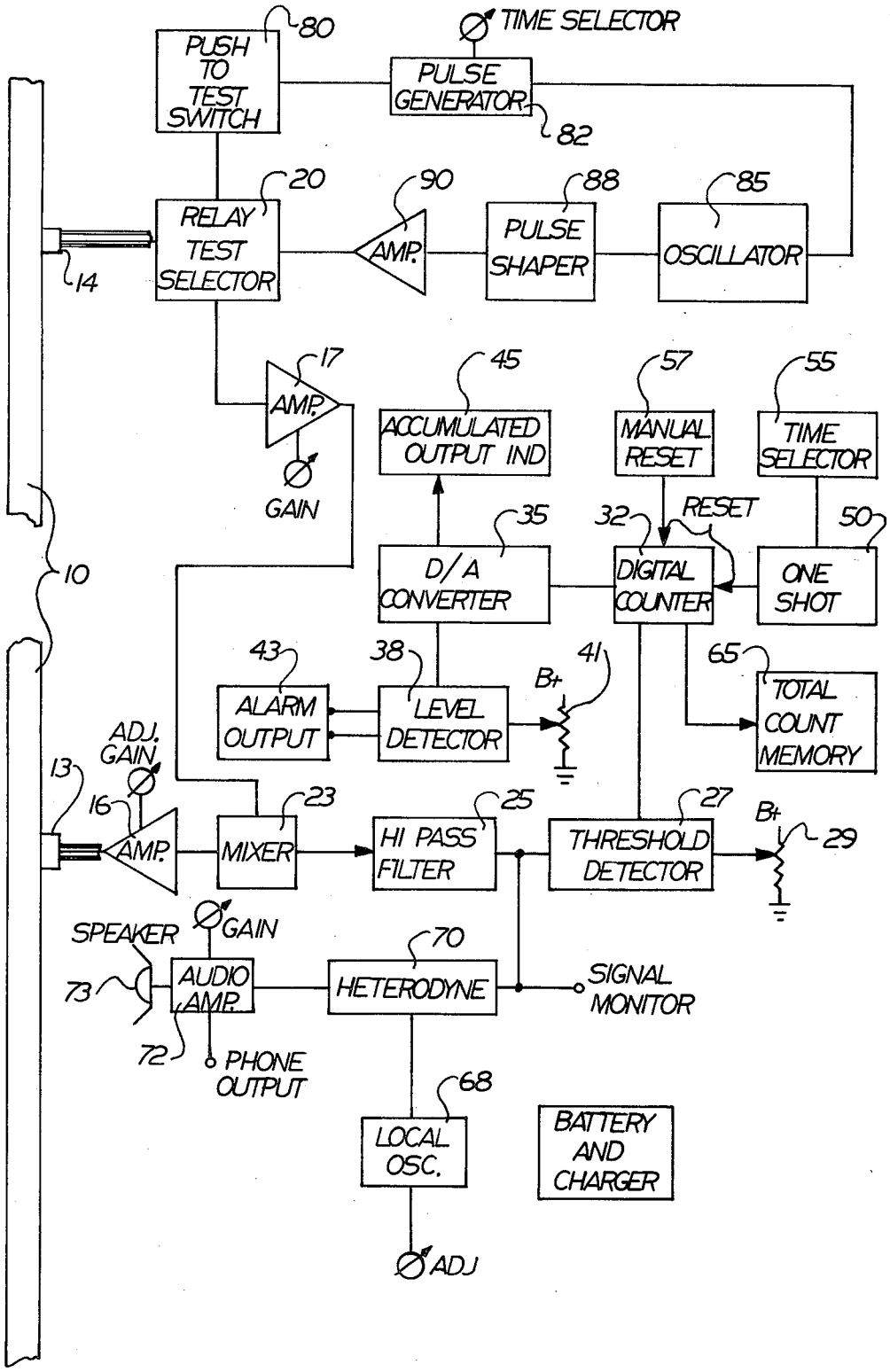
PUSH TO TEST SWITCH
80
TIME SELECTOR
PULSE GENERATOR
82
RELAY TEST SELECTOR
20
14
AMP.
90
PULSE SHAPER
88
OSCILLATOR
85
AMP.
17
GAIN
ACCUMULATED OUTPUT IND
45
MANUAL RESET
57
TIME SELECTOR
55
RESET
D/A CONVERTER
35
DIGITAL COUNTER
32
ONE SHOT
50
10
ALARM OUTPUT
43
LEVEL DETECTOR
38
B+
41
TOTAL COUNT MEMORY
65
ADJ. GAIN
13
16
AMP.
MIXER
23
HI PASS FILTER
25
THRESHOLD DETECTOR
27
B+
29
SPEAKER
GAIN
73
AUDIO AMP.
HETERODYNE
70
SIGNAL MONITOR
72
PHONE OUTPUT
LOCAL OSC.
68
BATTERY AND CHARGER
ADJ

ACOUSTIC EMISSION INTRUDER ALARM SYSTEM

This is a continuation of application Ser. No. 962,702, filed Nov. 20, 1978, now abandoned.

BACKGROUND OF THE INVENTION

This invention relates to burglar protection devices or systems and, more particularly, to systems which detect an attack upon a protected structure such as safes, vaults, and the like by detecting or sensing acoustic emissions emanated during an attack.

Such systems rely upon the ability of one or more sensors to respond to the acoustic emissions produced in the course of an attack upon a structure to produce an electrical signal. The signal is operated upon and ultimately employed to provide a warning signal at one or more selected remote locations. The acoustic emissions propagate through the structure to the sensors and are generated by physical attacks upon the structure employing drills, hammers, torches, burning bars and other implements designed to force entry into the protected structure. In addition, movement of the lock mechanism or tumblers will produce such emissions. The different modes of attack on a potential structure produce different patterns of acoustic emissions. The patterns involve different amplitudes and time durations.

One difficulty encountered with the present systems of the type described is the generation of excessive false alarms. The systems require that a balance be structured between sensitivity and stability and any errors result in favor of sensitivity. With such a balance, false alarms may be triggered by "noise"; that is, emissions detected by the sensors which are of sufficient amplitude to trigger an alarm are generated by activities other than physical attack upon a protected structure.

It is desirable, therefore, to provide such a system which has an improved ability to distinguish between emissions generated by a physical attack and those generated by other sources.

SUMMARY OF THE INVENTION

According to the present there is provided a system for detecting acoustic emissions produced by physical attack events on a protected structure which has improved ability to distinguish between an actual physical attack and noise generated acoustic emissions. In a system according to the invention, acoustic emissions exhibiting a frequency of less than about 50,000 Hz are filtered and are not permitted to effect an alarm system. It has been determined that the incidence of false alarms can be greatly reduced with no appreciable decrease in sensitivity to actual physical attacks by operating only upon acoustic emissions which exhibit frequencies greater than about 50,000 Hz. The emissions which exhibit frequencies below this value have been determined to be much more likely to have been generated by sources other than a physical attack upon the protected structure, such as seismic waves from trains or motor vehicles and audible sounds from the environment, while emissions which exhibit a frequency above that value are much more likely to have been generated by a physical attack upon a protected structure.

A system embodying the present invention includes acoustic sensor means adapted to be mounted on a protected structure so as to receive acoustic emission signals propagated through the structure from an attack area thereon. The sensor means is responsive to received emission signals for providing an event signal of a corresponding frequency and having an amplitude and duration dependent upon that of the received emission signals. High pass filtering means is coupled to the output of the emissions sensor for passing event signals exhibiting a frequency greater than about 50,000 Hz. Output means is coupled to a filter means for providing an event alarm depending upon the value of a filtered event signal.

BRIEF DESCRIPTION OF THE DRAWINGS

The single FIGURE of the drawing is a block diagram of an acoustic emission burglar detection system embodying the present invention.

DESCRIPTION OF PREFERRED EMBODIMENT

Referring now to the drawing, the number 10 indicates a wall or base of a protected structure such as a vault or the like employed for the safe keeping of valuable merchandise. One or more sensors 13, 14 are mounted on wall 10 to receive acoustic stress waves signals which may be propagated through the protected structure, such as metal or glass, to the sensors. The sensors 13 are piezoelectric transducers which convert the acoustic emission signals from mechanical stress waves to electrical signals of proportional amplitude and frequency. Sensors 13, 14 are responsive to emissions in a frequency range from about 50 Hz to 1,000,000 Hz. Sensors 13, 14 are connected by means of shielded cable to high gain, low noise amplifiers 16 and 17 respectively. Sensor 14 is connected to amplifier 17, through a test selector relay 20 for reasons described below. The output signals from amplifiers 16, 17 are combined or summed in a mixer 23.

The output signal from mixer 23 is thus an electrical signal representing the sum of the acoustic emissions received by sensors 13, 14. The signals from the sensors may represent not only emissions produced by the physical attacks upon the protected structure but also audible sound and other emissions of relatively low frequency which do not represent physical attacks upon a protected structure. Many of these emissions may be coupled to sensors 13 and 14 through the air. It has been discovered that emissions below about 50,000 Hz in frequency are almost always not caused by or produced by a physical attack upon the protected structure but are produced by some other source. In prior systems emissions in this frequency range have been the cause of numerous false alarms.

According to the present invention, the output from mixer 23 is provided to a high pass filter 25 which passes only signals having frequencies above 50,000 Hz while substantially eliminating signals having frequencies below that value.

The output of filter 25 is connected to a threshold detector 27 which provides an output pulse for each half cycle of the signals from filter 25 which exceed a preset threshold level. Threshold detector 27 may be a comparator amplifier having one input connected to the wiper of an adjustable potentiometer 29 which provides the preset threshold voltage.

The pulses from threshold detector 27 are provided to a counter 32. Counter 32 is connected to a digital to analog converter 35 which converts the count to an analog voltage and supplies this to a level detector 38. If the voltage exceeds a preset level, as determined by potentiometer 41, a signal is provided to initiate an alarm output 43. The output from converter 35 is also provided to a level indicator 45, such as a volt meter or the like.

Counter 32 is periodically reset by a pulse from one shot 50 which is triggered by a signal from time selector 55. The time selector may be a relatively low frequency pulse generator and divider circuit which provides a pulse to one shot 50 for every N pulses generated by the pulse generator. Counter 32 may also be manually reset by a switch or the like, as indicated at 57.

In operation, if emissions of sufficient amplitude and duration are detected between reset pulses to counter 32, the counter will be counted a value such that the analog equivalent of the count will exceed the reference voltage provided by potentiometer 41 and trigger an alarm from alarm device 43 to indicate a physical attack upon a protected structure. Counter 32 is reset periodically to prevent an accumulation of relatively infrequent noise signals over a long period of time from activating the alarm 43. Each time counter 32 is reset its contents are added to the contents of a total count memory 65. The count accumulated in memory 65 over, for example, a 24-hour period can be used to analyze and "fine tune" the system for its particular environment.

The acoustic emission signals from filter 25 may be monitored audibly by mixing the signals with those from a local oscillator 68 in a heterodyne circuit 70 to provide audible event indications. The audio signal from circuit 70 may be amplified in an amplifier 72 and provided to either a speaker 73 or earphones or both.

As mention above, the electrical signal from sensor 14 is connected to the input of amplifier 17 through a test selector relay 20. The circuitry described above can be tested and adjusted by switching test selector relay 20 to a test position and employ associated testing circuitry. In the test mode sensor 14 operates as a transducer in an opposite sense from its normal use; that is, to receive electrical pulses and produce mechanical stress waves in response thereto which are propagated through the protected structure to sensor 13. Pulses applied to sensor 14 can, therefore, be employed to simulate a physical attack upon the protected structure for the purpose of testing and adjusting the detection circuits.

Test selector relay 20 is switched to the test position by means of a switch 80 which enables also a low frequency pulse generator 82 to provide a series of rectangular enabling pulses to an oscillator 85. Both the width and the rate of delivery of pulses from the pulse generator 82 are adjustable. Upon receipt of each rectangular pulse, oscillator 85 is enabled to provide pulses at a selected rate for the duration of the enabling pulse to sensor 16 through test selector relay 20, a pulse shaper 88 and an amplifier 90. By adjusting the rate and duration of pulses from pulse generator 82, different forms and durations of physical attack upon the protected structure can be simulated. Pulse generator 82 is enabled so long as switch 80 is in the test position. The detection system described above is preferably supplied with power from a battery which is periodically recharged. This permits operation in the event that the primary AC line is cut. The detection equipment is physically mounted in the protected structure and is thereby protected against attempts to nullify its operation.

What is claimed is:

1. An acoustic emission intruder detection system for detecting physical attacks made on a protected structure which exhibits the characteristic of transmitting acoustic emission stress wave signals therethrough from the area of the attack, comprising:

acoustic sensor means adapted to be mounted on said protected structure so as to receive stress wave signals propagated through said structure from an attack area, said sensor means being responsive to received stress wave signals for providing an event signal of a corresponding frequency and having an amplitude and duration dependent upon that of said stress wave signals, high pass filtering means for passing event signals exhibiting a frequency greater than about 50,000 Hz, and output means for providing an event alarm dependent upon the value of said filtered event signal, wherein said acoustic sensor means comprises a plurality of piezoelectrical transducers and further comprising a circuit means for providing electrical signals to one of said transducers to simulate a physical attack upon said protected structure.

2. An acoustic emission intruder detection system for detecting physical attacks made on a protected structure which exhibits the characteristic of transmitting acoustic emission stress wave signals therethrough from the area of the attack, comprising:

signal means including acoustic sensor means adapted to be directly mounted on said protected structure so as to receive stress wave signals propagated through said structure from an attack area, said signal means being responsive to received stress wave signals for providing an electrical signal of a corresponding frequency to that of said stress wave signals and having an amplitude and duration dependent upon that of said stress wave signals, means for passing as pulses only those portions of said electrical signal which exceed a threshold level, resettable digital counting means for receiving and counting all of said passed pulses from said threshold level means and providing a digital count signal representative of the number of pulses counted, means for resetting said counting means, means for continuously converting said digital count signal to an analog signal as said counting means is counting said passed pulses, and means for comparing said analog signal with an alarm reference level to provide an alarm signal dependent upon said comparison.

3. A system as set forth in claim 2 wherein said resetting means includes means for manually resetting said counting means.

4. A system as set forth in claim 2 wherein said resetting means includes timing means for periodically resetting said counting means.

5. A system as set forth in claim 4 including means for adjusting said timing means to vary the elapsed time period for resetting said counting means.

6. A system as set forth in claim 2 including means for monitoring said electrical signal including local oscillator means for providing a pulse train and heterodyne means for mixing said electrical signal with said pulse train to provide an audible frequency signal and audio means for providing an audible signal therefrom.

7. A system as set forth in claim 6 including means for varying the frequency of said local oscillator pulse train.

8. A system as set forth in claim 2 wherein said signal means includes a plurality of said acoustic sensor means each adapted to be directly mounted on a said protected structure whereby each said sensor means provides a said electrical signal and mixer means for mixing said electrical signals and supplying same to said threshold level passing means.

9. An acoustic emission intruder detection system for detecting physical attacks made on a protected structure which exhibits the characteristic of transmitting acoustic emission stress wave signals therethrough from the area of the attack, comprising:

signal means including acoustic sensor means adapted to be mounted on said protected structure so as to receive stress wave signals propagated through said structure from an attack area, said signal means being responsive to received stress wave signals for providing an electrical signal of a corresponding frequency and having an amplitude and duration dependent upon that of said stress wave signals, means for passing as pulses only those portions of said electrical signal which exceed a threshold level, resettable digital counting means for counting said passed pulses and providing a digital count signal representative of the number of pulses counted, means for resetting said counting means, means for converting said digital count signal to an analog signal, means for comparing said analog signal with an alarm reference level to provide an alarm signal dependent upon said comparison, and said resetting means including timing means for periodically resetting said counting means, means for adjusting said timing means to vary the elapsed time period for resetting said counting means, and total count memory means for maintaining a count of the total number of pulses counted by said counting means.

* * * * *